United States Patent [19]

Klotz

[11] Patent Number: 4,539,545

[45] Date of Patent: Sep. 3, 1985

[54] THERMAL SWITCH

[75] Inventor: Willi Klotz, Unterreichenbach, Fed. Rep. of Germany

[73] Assignee: Microtherm GmbH, Pforzheim, Fed. Rep. of Germany

[21] Appl. No.: 614,457

[22] Filed: May 25, 1984

[30] Foreign Application Priority Data

May 27, 1983 [DE] Fed. Rep. of Germany ..... 3319227

[51] Int. Cl.[3] ..... H01H 37/04; H01H 37/52

[52] U.S. Cl. ..... 337/380; 337/365; 337/375

[58] Field of Search ..... 337/365, 372, 343, 89, 337/373, 374, 375, 380, 381; 335/154

[56] References Cited

U.S. PATENT DOCUMENTS

| | | | |
|---|---|---|---|
| 2,740,864 | 4/1956 | Tsai | 337/375 |
| 3,943,474 | 3/1976 | Schlesinger et al. | 335/154 |
| 4,039,985 | 8/1977 | Schlensinger et al. | 335/154 |
| 4,039,992 | 8/1977 | Givler | 337/365 |

*Primary Examiner*—Harold Broome
*Attorney, Agent, or Firm*—Frost & Jacobs

[57] ABSTRACT

In a thermal switch for temperature control of electrical heating apparatus, a contact reed is integral with a terminal and is rigid except for a relatively short longitudinal area so that, when the contact reed is acted upon by a bimetallic disk spring, a hinge type movement of the contact reed will result.

The integral rigid design of this component designed as terminal and contact reed makes keeping the geometric conditions within the thermal switch, especially the space between the contact reed and the bimetallic disk spring, at closer tolerances, much easier than with prior leaf springs used as a contact reed. Accomplished thereby is a more dependable switching performance and thus a quality improvement in large-scale manufacture and a reduction in manufacturing costs.

A particularly simple design uses instead of rivets, which serve to fasten the two terminal lugs to the support structure, stamped shapes stamped out of the terminal lugs so that the total number of parts for the thermoswitch can be reducted to four, with the bimetallic disk, as opposed to prior solutions, not having a contact.

The invention also permits a simple retention and guidance of the bimetallic disk spring, permitting an easy insertion and/or replacement of the bimetallic disk spring in the completely assembled thermal switch.

4 Claims, 3 Drawing Figures

THERMAL SWITCH

BACKGROUND OF THE INVENTION

The invention concerns a thermal switch for temperature control of electrical heating apparatus wherein the stationary end of a contact reed and its opposite contact are mounted, insulated against one another, on a support structure, wherein the contact reed connects in an electrically conductive fashion with a terminal lug and can be so loaded by a bimetallic disk spring that it will lift off the opposite contact.

An electrical thermal switch of this design is previously known from the German published patent application No. 20 57 003. In this prior thermal switch, the feeding of current to the contact reed is accomplished by way of the termial lug made from a rigid stable material, which lug is to resist mechanical loads whereas the contact reed itself is fashioned as a leaf spring whose one end is welded to the terminal lug while its other end supports the contact. A suitable prestress of the spring material produces the necessary contact pressure. The underside of the leaf spring bears on a bimetallic disk spring.

It has been demonstrated that this design has several disadvantages associated therewith:

Making the welding connection between terminal lug and leaf spring is expensive and thus a considerable cost factor. Intolerances in welding, on one hand, but also not completely manageable distortions and curvatures of the leaf spring, on the other hand, affect the reliability of the function, i.e., of the switching operation:

For the production of reliable large-scale products it is important to accomplish a proven switching performance as the bimetallic disk spring responds, that is, the superimposed contact points of leaf spring and bimetallic disk spring must have a defined spacing which is reproducible in mass production with tolerances as narrow as possible. This cannot be completely accomplished with the prior art structures for the above reasons; consequently, considerable quality and functional defects may occur in mass production.

SUMMARY OF THE INVENTION

The problem underlying the invention is therefore to so improve the prior art thermal switch that its manufacture will become cheaper and its function more reliable.

This problem is solved in the present invention by providing that the contact reed and the terminal are integral, that the contact reed is rigid with the exception of a relatively short section, and that this section will so respond to bending stress that a knuckle or hinge effect is obtained.

Obtained through the integral, extensively rigid design and the concentration of the spring properties in a small longitudinal area in accordance with the invention is a practical contact reed with a hinge type effect whose geometry, that is, whose relative position to the bimetallic disk spring involves only minimal tolerances, thereby drastically reducing quality and functional shortcomings in mass production.

The manufacture requires fewer tools. In addition, the increased thickness of the contact reed enables greater current loads as well as using inlay or toplay contacts.

The contact reed can be made from several materials, the type and dimensioning of the spring distance being easily determinable by tests.

An expecially favorale embodiment of the thermal switch of the invention provides for forming mountings on the two terminal lugs which slip over corresponding projections on the support structure for fastening thereon.

This eliminates the use of rivets for fastening the terminal lugs on the support structure, enabling for the first time a thermal switch which is composed of only four parts, without using a contact on the bimetallic disk spring, namely consisting of the support structure, the first terminal lug with the contact reed, the second terminal lug and the bimetallic disk spring.

Further embodiments of the invention derive from the description and dependent claims.

Two embodiments will be more fully explained hereafter with the aid of the drawings.

DETAILED DESCRIPTION

Figure 1:
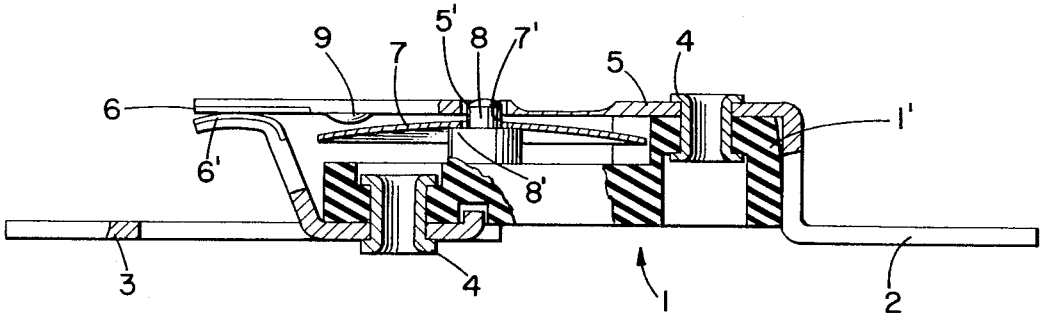
FIG. 1 shows a cross-section of a thermal switch according to a first embodiment.

An insulating material block 1, which may comprise only a prism-shaped part 1' or may also be provided with a fastening projection, supports on the rear end of part 1' a terminal lug 2 and on its front end another terminal lug 3, which in the first embodiment according to FIG. 1 are fastened with countersunk hollow rivets 4. Integral with the first terminal lug 2 is a contact reed 5 featuring on its front end, on the bottom side, a contact 6. In the closed condition of the switch, the contact 6 bears on the opposite contact 6' which is bent upward out of the terminal lug 3.

Arranged underneath the contact reed 5 is a bimetallic disk spring 7 which, with the aid of a central bore 7', is mounted on a stud 8 which is molded on the block 1', the disk spring bearing on a shoulder 8' of the stud. The stud 8 extends also into a bore 5' in the contact reed 5, the diameter of the bore providing sufficient clearance for passage of the stud. On its bottom side, the contact reed 5 features a protrusion 9 which is located on its center axis and serves as bearing point for the bimetallic disk spring 7.

Upon reaching the maximum permissible temperature, the bimetallic disk spring 7 reverts as usual. In doing so, it contacts with its rear or peripheral section the reed 5 and with its center the shoulder 8' of the stud 8. The entire reversal of the bimetallic disk spring 7 thus becomes effective on the projection 9 on the reed 5, therey producing a long switching path for the contact 6. The reed 5 features, in accordance with the invention, a cross-sectional taper from approximately 0.5 mm to for instance 0.2 mm above the rear area of the bimetallic disk spring. Formed thereby is a springy hinge area that forces the front or free end of the reed 5 with the contact 6 onto the opposite contact 6', for which purpose the contact reed 5 is in its manufacture provided with the appropriate prestress. The prestress can be obtained, e.g., through angling the contact end by 5° relative to the terminal end. Incidentally, the rigid design of the reed 5 is favorable here as well, since through observance of a defined prestress angle the contact force exerted on the opposite contact 6', in mounted condition, will as well remaining within defined limits, which favorably influences the reliability of the switching performance.

Suitable materials for the integrated manufacture of the contact reed and the terminal lug are, e.g., brass, copper, roll bronze, nickel silver, and also steel.

Figure 2:
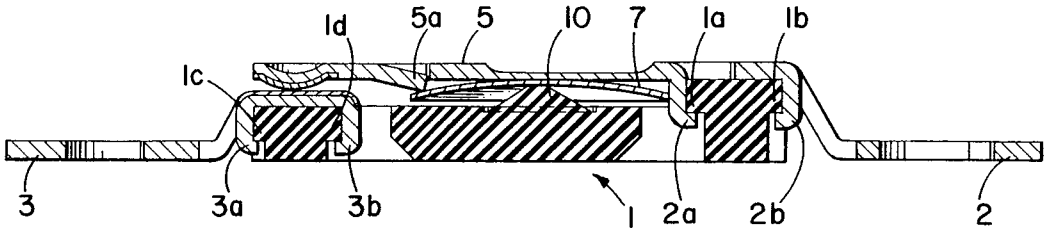
FIG. 2, a cross-section of a thermal switch according to a second embodiment.
Figure 3:
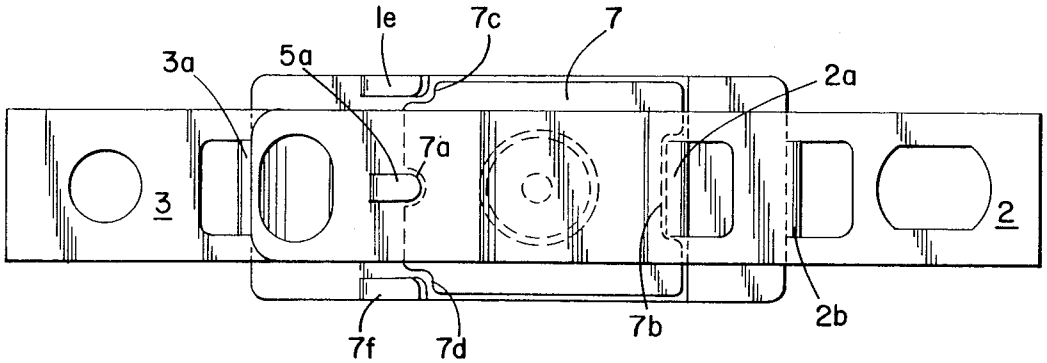
FIG. 3, a plan view of a thermal switch according to FIG. 2.

The second embodiment of the thermal switch of the invention (FIGS. 2 and 3) features a further simplification inasmuch as the fasteners for attachment of the terminal lugs to the support structure 1 are clip- or claw-shaped fasteners 2*a*, 2*b*, and 3*a*, 3*b*, instead of rivets 4 (FIG. 1), which are stamped and formed out of the terminal lugs 2, 3 and fit around correspondingly formed projections 1*a*, 1*b* and/or 1*c*, 1*d* on the support structure 1. This results in a considerable simplification of assembly. The two terminal lugs 2 and 3 only need be placed with angled fasteners 2*a*, 2*b* and 3*a*, 3*b* on the corresponding parts of the support structure 1, then bending the fasteners over so that the angled bottom end fits around the projections 1*a* . . . 1*d*, assuring a dependable fit.

As compared to the first embodiment, the mounting and guidance of the bimetallic disk spring 7 is simplified here as well:

The bimetallic disk spring 7 features in its peripheral area recesses 7*a* . . . 7*d* which interact with corresponding shapes 1*e*, 1*f*, 5*a* and the fastener 2*a*.

At closed contact, the bimetallic disk spring 7 is quided with its rear recess 7*b* by the fastener 2*a*, with the two symmetrical front recesses 7*c*, 7*d* by the projection 1*e*, 1*f* of the support structure 1. In its center, the bimetallic disk spring 7 rests on a projection 10 of the support structure 1 which has the shape of a truncated cone.

In reverse conditon (contact open), the bimetallic disk spring 7 continues to be guided at its rear end by the fastener 2*a*. On its front end, the receses 7*c*, 7*d* part from their corresponding holders 1*e*, 1*f*. In the upward movement of the edge of the bimetallic disk spring 7, however, the recess 7*a* engages a correspondingly down-stamped section 5*a* of the reed 5, guaranteeing here as well a satisfactory fastening and/or guidance.

This guidance by corresponding elements in the edge areas of the bimetallic disk spring 7 makes it possible to eliminate a central bore in the bimetallic disk spring and the stud 8, as compared to the embodiment shown in FIG 1, which entails the considerable advantage that the bimetallic disk spring can, after installation of the two termainal lugs on the support structure 1, be inserted in the thermal switch through a slight lifting of the contact reed 5, fitting into corresponding recesses 7*b*, 7*c*, 7*d* in the respective opposed components.

What is claimed is:

1. In a thermal switch for temperature control of electrical heating apparatus, comprising a contact reed having a stationary end and a free end, said stationary end being mounted on a suport structure in electrically conductive relation to a terminal, a contact opposite said free end mounted on said support structure, said stationary end and said contact being electrically insulated from each other, and a bimetallic disk spring located intermediate the ends of said contact reed in such manner as to lift said free end off said opposite contact when said disk spring reverts upon reaching a maximum permissible temperature, said contact reed being rigid with the exception of a relatively short longitudinal section acting in the manner of a hinge when subjected to elastic bending stress, the improvement wherein said contact reed and terminal are integral and have the same thickness except for said longitudinal section, said opposite contact and said free end facing said contact are fashioned as one of an inlay and toplay contact, claw-shaped fasteners are formed out of said terminal which fit around a projection on said support structure, and wherein a second terminal is provided having claw-shaped fasteners formed therefrom which are secured to said support structure remote from said first-mentioned terminal.

2. Thermal switch according to claim 1, characterized in that said contact reed features in its area pointing toward the contact end and located above an edge of the bimetallic disk spring a clip type shape pointing toward said bimetallic disk spring and aligned on a corresponding cutout in the edge of said bimetallic disk spring.

3. Thermal switch according to claim 2, characterized in that said bimetallic disk spring contains in its edge area toward said terminal another cutout which fits around the terminal lug and is guided by one of said fasteners.

4. Thermal switch according to claim 3, characterized in that said bimetallic disk spring, on its corners pointing toward said second terminal, is provided with further cutouts which engage projections of said support structure.

* * * * *